US005997041A

United States Patent [19]

Tan

[11] Patent Number: 5,997,041

[45] Date of Patent: Dec. 7, 1999

[54] BOOK

[76] Inventor: Whang Kwee Tan, 17 A. Ah soo Garden, Singapore, Singapore, 539976

[21] Appl. No.: 09/234,222

[22] Filed: Jan. 20, 1999

[51] Int. Cl.[6] ..... B42D 1/00

[52] U.S. Cl. ..... 281/21.1; 281/36; 281/47; 402/46; 402/47; 402/68

[58] Field of Search ..... 281/15.1, 21.1, 281/28, 38, 45, 46, 47; 402/46, 47, 68, 60, 70, 73

[56] References Cited

U.S. PATENT DOCUMENTS 4,056,326 11/1977 Crawford ..... 402/46 X
4,113,394 9/1978 Giulie ..... 402/46
4,426,007 1/1984 Beleckis et al. ..... 281/47 X
4,561,623 12/1985 Shepherd et al. ..... 281/47

*Primary Examiner*—Willmon Fridie, Jr.

[57] ABSTRACT

A photo album assembled with the minimum use of machinery. Making use of a special designed multipurpose plastic holder, a stack of paper or a stack of plastic pockets, a plurality of posts and two pieces of special designed cover panels. By using the multipurpose plastic holder and special designed cover panels, the photo album may appear in different structural looks.

15 Claims, 8 Drawing Sheets

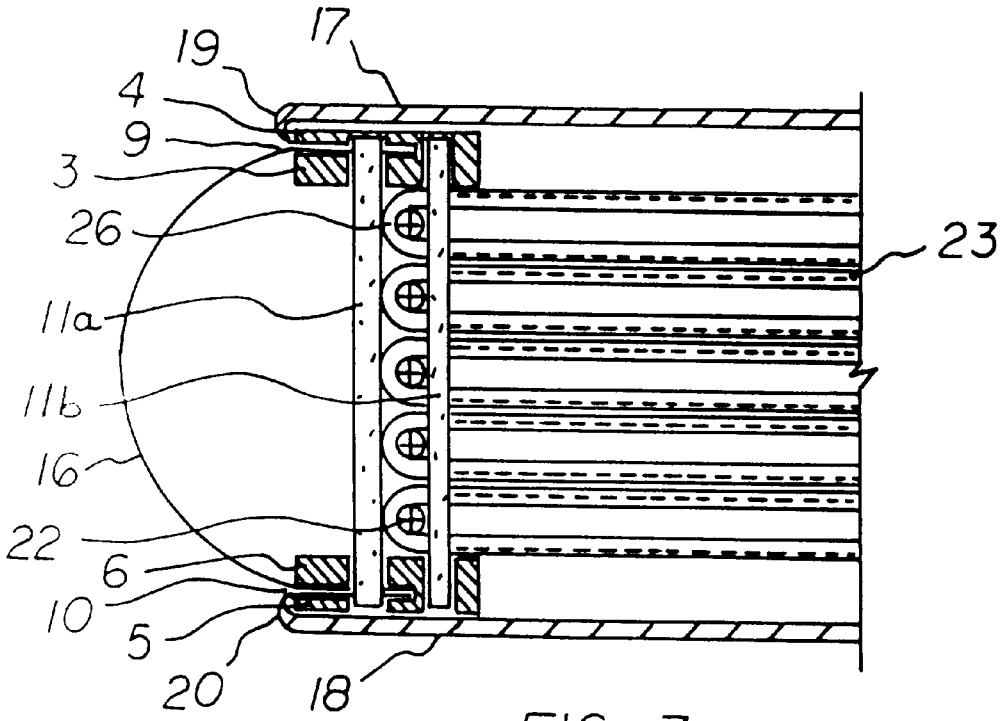
FIG 3
FIG 4A
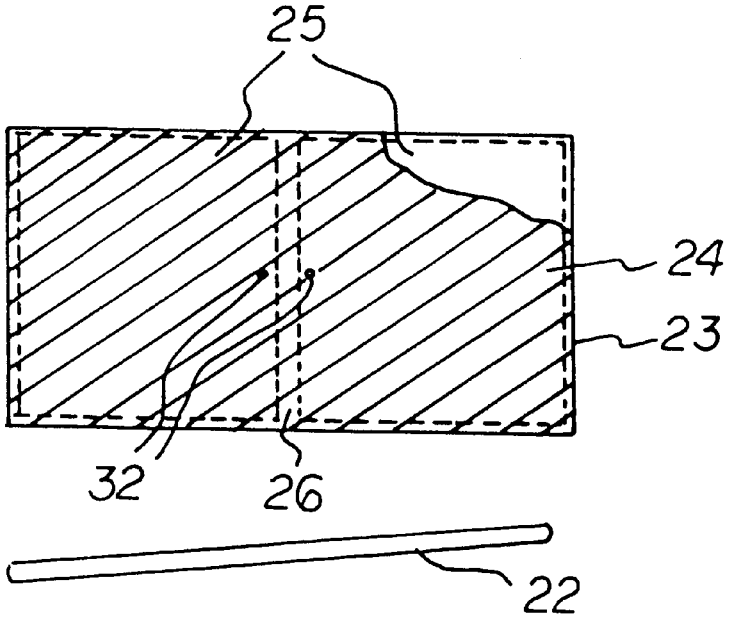
FIG 4B

FIG 8
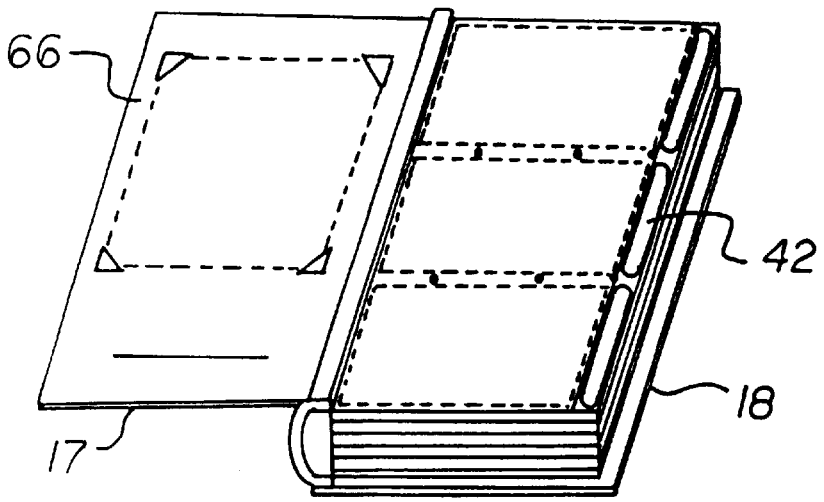
FIG 9
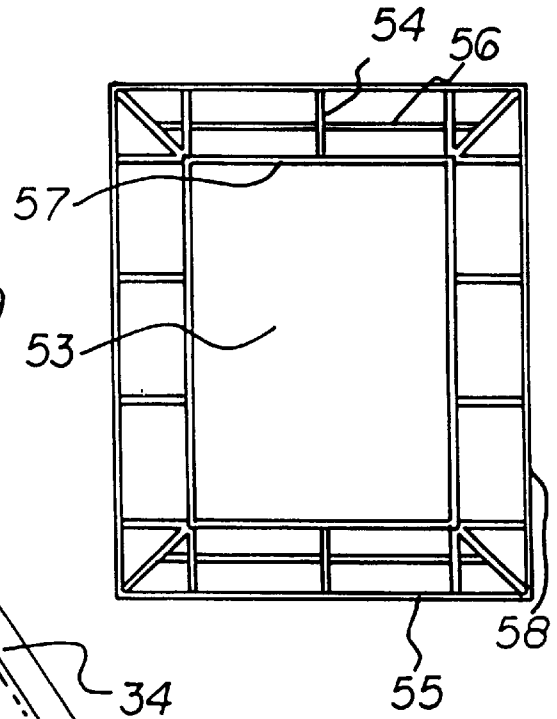
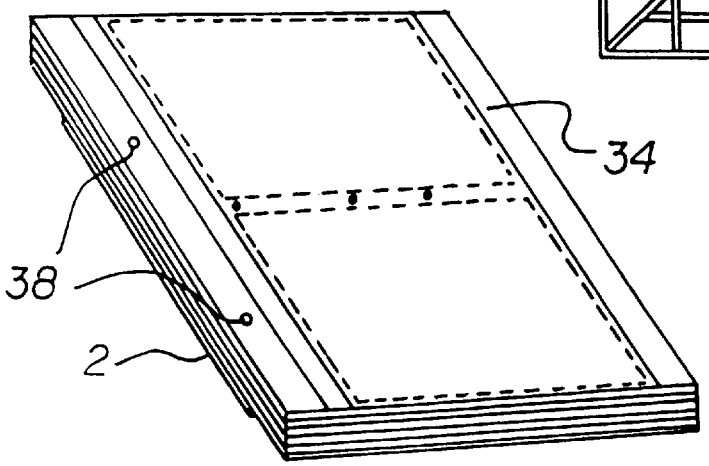
FIG 7

FIG 16
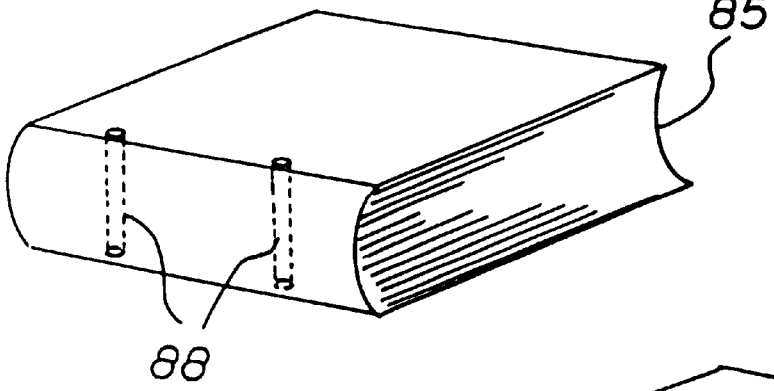
FIG 18
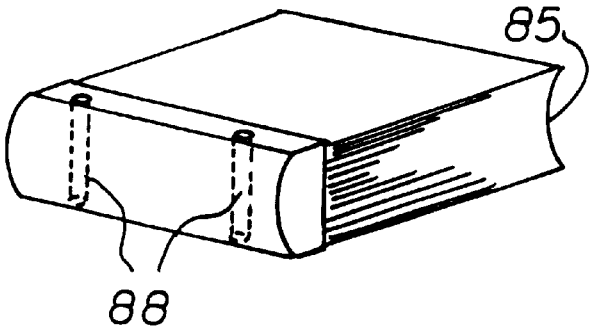
FIG 17
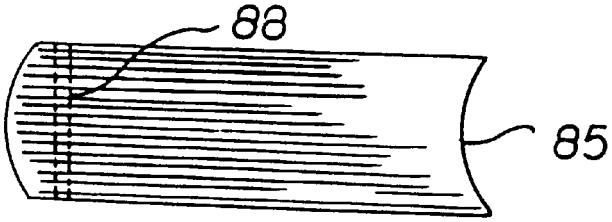
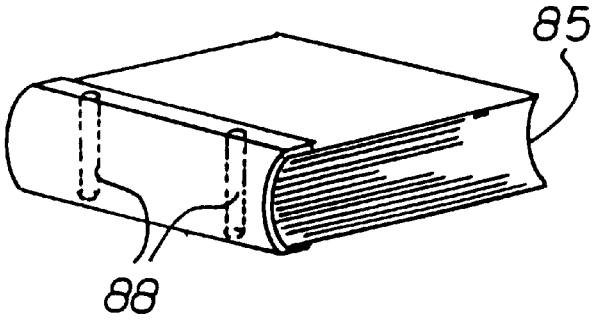
FIG 19

BOOK

BACKGROUND OF THE INVENTION

1. Field of the Invention

The present invention relates to a book system and, more particularly, pertains to maximizing the convenience and aesthetic appearance of photograph albums and like books while minimizing costs.

2. Description of the Prior Art

Photo albums are commonly known to have a few binding methods which give different structural looks to the photo album. The most commonly used binding methods are: 1) binding with metal rings; 2) binding with spiral rings; 3) binding with nuts and screws; 4) binding with adhesive material; and 5) book binding. Most of these binding methods require expensive metal components to bind the covers and pages together such as metal rings, copper nuts and screws. These components add significant cost to production and inventory. Secondly, in order to apply these methods to produce photo albums, manufacturers have to invest more capital to purchase machinery as these binding methods require machines such as coiling machines, heat sealing machines, perfect binding machines, sewing machines, and the like.

All of these methods create three similar problems to the manufacturers: 1) high cost of production; 2) low productivity; and 3) high capital investment for machinery. In order to have profit in the market, manufacturers have to think of ways to reduce their overheads either by using cheaper quality raw materials or by cutting wages on workers. Cutting wages on workers produce low morale and create poor incentives to produce any good quality products.

One other hindrance exists besides the traditional binding methods hindering the development of the manufacturers in the photo album industry. This hindrance is the process of making the cover panels. Traditionally, cover panels are produced by wrapping printed paper to paperboard with adhesive material. This way of making the cover panel will incur massive work load which will increase production cost and high capital investment in machinery. But the most significant hindrance in the development for any innovative photo album is not just the cost but the designing structure of the photo album being produced.

To most of the general public, a photo album is common and yet important. During the life of most of the consumers, there are hundreds of events of times they will take pictures, such as on weddings days, new birth of a child, birthdays, graduations and so forth. Every single photograph taken must be meaningful and precious to them. Therefore, it is very often and common for them to buy photo albums to store their memories which thy cherish. But an album that has high quality and yet is inexpensive to purchase is not commonly found in the market for their satisfaction.

Thus, there exists a need in the market for a more versatile photo album that features high quality, elegance, economy and suitability for all occasions. In this regard, consumers need a novel album to help them cherish their photographs. The manufacturing form cover making to the binding of the album, a way that will benefit the manufacturers and the consumers.

SUMMARY OF THE INVENTION

In summary, the present invention essentially comprises a book comprising a spine formed of a plurality of walls including a front wall and a rear wall, each with an axial recess therewithin, the spine also having a plurality of panels including a top panel and a bottom panel with the top panel and bottom panel being in parallel relationship with each other adjacent to the top of the walls and adjacent to the bottom of the walls, the walls and panels being in a rectilinear configuration with an open planar face from which pages may extend and a closed face opposite therefrom, and with the walls being formed with circular apertures for the receipt of pins therethrough; a plurality of pins passing through at least some of the side walls to retain the pages in position; and a plurality of pages positioned within the spine and extending outwardly in a direction away from the closed face for the removable receipt of photographs and like image-bearing documents for maximized convenience and aesthetic appearance with minimized cost.

The principle objective of the invention, therefore, is to provide a new and improved album that is totally different from the traditional album, one that is simple and inexpensive to manufacture, one that has supreme quality yet reasonable price to the consumers, and one that may be versatile in accommodating photographs of all occasions.

In general, the invention of the photo album is comprised of: 1) a specially designed multipurpose plastic spine; 2) a plurality of posts; 3) a stack of plastic pockets filled with printed paper or blank paper; 4) two pieces of specially designed cover panels; and 5) design materials for cover.

The binder of the album is an important part to a photo album as it functions very much like the spine of the human being. It is the main component holding the member parts of the photo album together. Traditional photo albums are comprised of two cover panels, album pages as a means of storage of photographs, and a means of connection such as metal rings, nuts and screws, adhesive material, and/or spiral rings to hold the parts together. The present invention is a new concept relating to the means of connecting the panels and the album pages together. Instead of utilizing the above mentioned traditional connection means, the present invention uses a plastic spine as a means of connection. This new means of connection will give the photo album industry a new method of production by providing different structural looks to the photo album and, most importantly, an improved new product to the consumers.

To produce photo album pages for the storage of photographs, the present invention uses a stack of transparent plastic pockets and a plurality of posts. The transparent pockets are first filled with printed papers. They are then aligned. The stack of plastic pockets are folded symmetrically face to face and hung on the posts. Next, the posts are pushed into the slots located in both ends of the specially designed holder that serves as the spine of the photo album and then are locked tight. Photo albums produced by using this method will be similar in appearance to those produced by using the ring binding, spiral binding and the heat sealing binding.

Another type of album page that can be utilized with the plastic spine is a transparent plastic sleeve which has the left and right sides open thus allowing photographs to insert from the side farthest from the spine. The advantages for photographs inserting from the side farthest from the spine will help manufacturers save a lot of material. This orientation also provides more convenience for consumers when inserting photographs as opposed to most of the photo albums found in the market which are designed for inserting photographs from the side nearest to the spine.

The cover panels are made of a plastic molding skeleton. The skeleton basically consists of two frames connected by supporting bridges. The outer frame is shorter than the inner frame which, when adhered with cover materials such as printed paperboards, produces a sloping effect on the cover. The edges of the outer frame are very special, as there are grooves created. The purpose of the groove is to give the edges a very unique finishing.

By using the present methods to produce cover panels, such as using printed paper wrapping onto paperboard, much work is involved and material is wasted. But the most important disadvantage as mentioned previously is that designers are limited only to the changing of artwork designs with printed paper and cannot go beyond this concept. In the present invention, the designers are provided an opportunity to go beyond the traditional way. Now there is a wild and wide sky for them to realize their creation. Designers can now employ different materials such as fabric, embossed cardstock, metal plates and even actual ornamental materials and three-dimensional designs to create the cover. One of the advantages of this multipurpose specially designed cover panel is consumers are given an option to put their own favorite design or photograph in the front cover. This is accomplished by simply compressing the sponged area in the cover panel and placing their desired artwork or material over the original design.

Once the album pages are installed into the multipurpose spine, the two cover panel hinges and the spine cover are next simply installed to the gaps provided in the multipurpose spine, then retained and locked tightly in the spine by the use of the posts. In this manner, the assembly of the photo album is completed.

In view of the foregoing, the invention may be summarized as a book system with pages comprising an album for the removable receipt of photographs and like image-bearing documents. The book system includes a spine formed of a plurality of walls including a front wall and a rear wall. Each front and rear wall has an axial recess therewithin. The spine also has a plurality of panels including a top panel and a bottom panel with the top panel and bottom panel being in parallel relationship with each other adjacent to the top of the walls and adjacent to the bottom of the walls. The walls and panels are in a rectilinear configuration with an open planar face from which pages may extend and a closed face opposite therefrom. The walls are formed with circular apertures for the receipt of pins therethrough. A plurality of pins pass through at least some of the side walls to retain the pages in position. A plurality of pages are positioned within the spine and extend outwardly in a direction away from the closed face.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those-set forth above will become apparent when consideration is given to the following detailed description thereof. Such description makes reference to the annexed drawings wherein:

FIG. 3 is a cross-sectional view of the completed book system from C—C in FIG. 1.

FIG. 4A is a detailed view of a single pocket album page for post hanging.

FIG. 4B is a perspective view of the post for hanging album pages.

FIG. 7 is a detailed view of the album held by a plate.

FIG. 8 is a detailed view of the way the album will look when filled with pictures.

FIG. 9 is a detailed view of the skeleton of the plastic molding of the cover panel.

FIG. 16 is a perspective view of the completed book shown in FIG. 15.

FIG. 17 is an end view of the book shown in FIG. 16.

FIG. 18 is a perspective view of an alternate embodiment of the invention.

FIG. 19 is a perspective view of another alternate embodiment of the invention.

The same reference numerals refer to the same parts throughout the various Figures.

Figure 1:
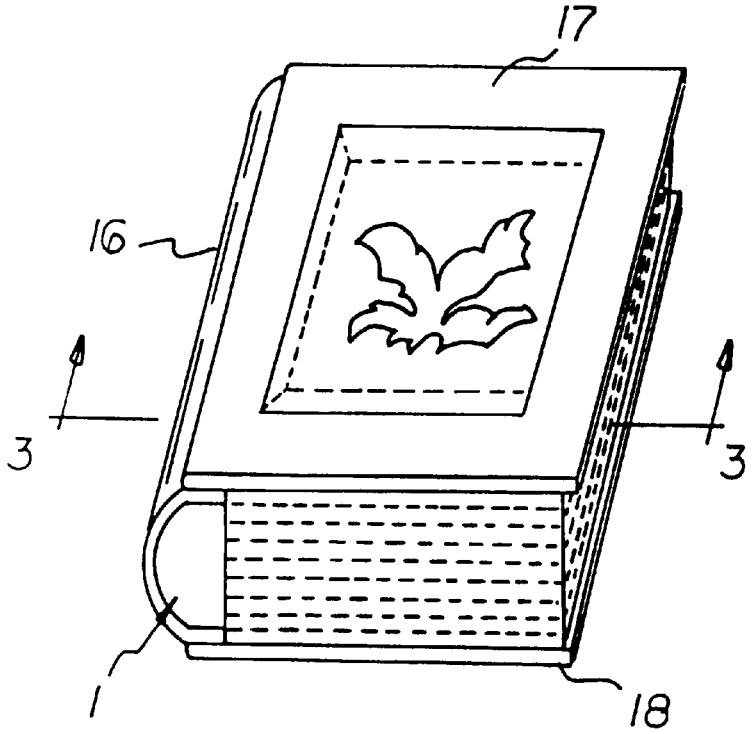
FIG. 1 is a perspective illustration of the preferred embodiment of the new and improved book system constructed in accordance with the principles of the present invention.

The accompanying drawings which are incorporated into and constitute a part of the description of the invention illustrate embodiments of the invention and serve to explain the principles of the invention. It is to be expressly understood, however, that the drawings are for the purpose of illustration and description only, and are not intended as a definition of the limits to the concept of the invention.

DESCRIPTION OF THE PREFERRED EMBODIMENT

With reference now to the drawings, and in particular to FIGS. 1 through 11 thereof, the preferred embodiment of the new and improved book system embodying the principles and concepts of the present invention will be described.

The present invention, the new and improved book system with pages 23, is a system comprised of a plurality of components. Such components, in their broadest context, include a spine including four walls, two panels and an arcuate face, cylindrical posts, spine pins, an outboard spine pin, a plurality of pages, front and back covers, and a flexible sheet. Each of the individual components is specifically configured and correlated one with respect to the other so as to attain the desired objectives.

The present invention is essentially a book or album system with pages 23 for the removable receipt of photographs and like image-bearing documents. The system as set forth hereinbelow is designed for maximized convenience and aesthetic appearance with minimized manufacturing cost, thus lowering the purchasing cost to the consumer.

The first component of the system is a spine 1. The spine includes four walls, an interior front wall 3 and an exterior front wall 4 and an interior rear wall 6 and an exterior rear wall 5. All of the walls are planar in essentially parallel relationship with each other. The interior and exterior front walls are closely spaced and the interior and exterior rear walls are closely spaced. An enlarged opening is formed therebetween for the receipt of pages 23,. The spine includes two panels, a top panel 7 and a bottom panel 8. The top panel and bottom panel are in parallel relationship with each other and coupled at the top of the walls and at the bottom of the walls for the receipt of pages 23 therebetween. The four walls and two panels are in a rectilinear configuration with an open planar face from which pages 23 may extend and a closed arcuate face opposite therefrom. The arcuate face includes three sets of curved fingers 14, 15 on each interior wall to define a curvature opposite from the open planar face. The interior faces of the panels are formed with a rectilinear section with indentations 13 opening toward the arcuate face for the receipt of ends of posts 22 therewithin. The walls are formed with circular inboard apertures 12 and outboard apertures 11*a*, 11*b* for the receipt of inboard spine pins 21*a* and at least one outboard spine pin 21*b* therethrough.

Next provided as a major component of the system are a plurality of cylindrical posts 22. The cylindrical posts have opposite ends adapted to be received in the indentations 13 of the rectilinear sections for the receipt of pages 23 therearound.

The third major component of the system is a pair of inboard spine pins 21*a*. The spine pins pass through the side walls to retain the posts in position within the recesses. The present invention contains at least one outboard spine pin 21*b*. This spine pin passes through the side walls and through apertures 32 in the pages 23.

Further provided as a major component of the system are a plurality of pages 23 of an extended length. The pages are formed with a central fold line adapted to be positioned over the posts and to extend outwardly in a direction away from the arcuate face. The pages have apertures 32 for the receipt of the outboard spine pins 21*b*.

Next provided are a front cover 17 and a back cover 18. The front and back covers are formed each in a generally rectangular configuration with an inner edge adapted to be received between an interior wall and an exterior wall at the open face.

Lastly provided as a component of the system is a flexible sheet 16. The sheet is in a semi-cylindrical configuration having free parallel edges positioned between the interior and exterior walls at the closed face and overlying the curved fingers. The sheet functions as a cover for the spine.

Function of the Spine

Figure 2:
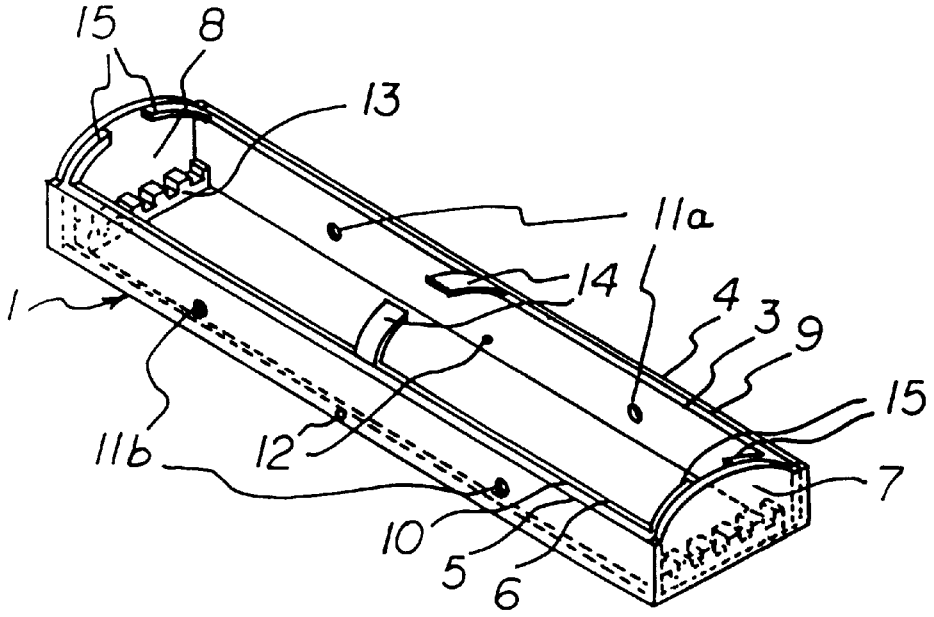
FIG. 2 is a perspective view of the plastic spine.
Figure 5:
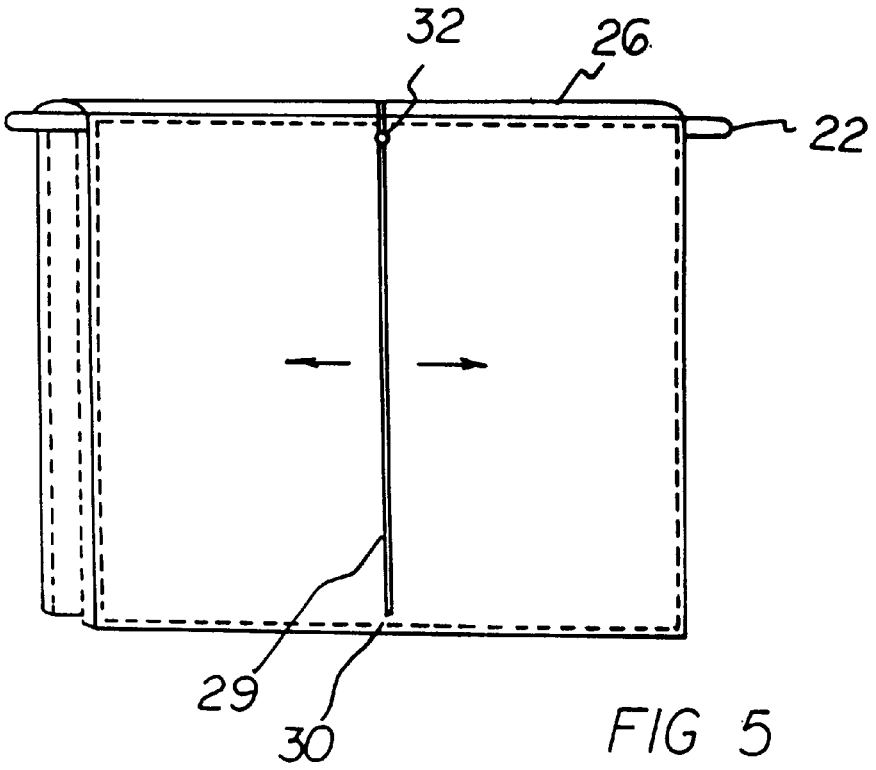
FIG. 5 is a perspective view of album pages hanging onto a post.
Figure 6:
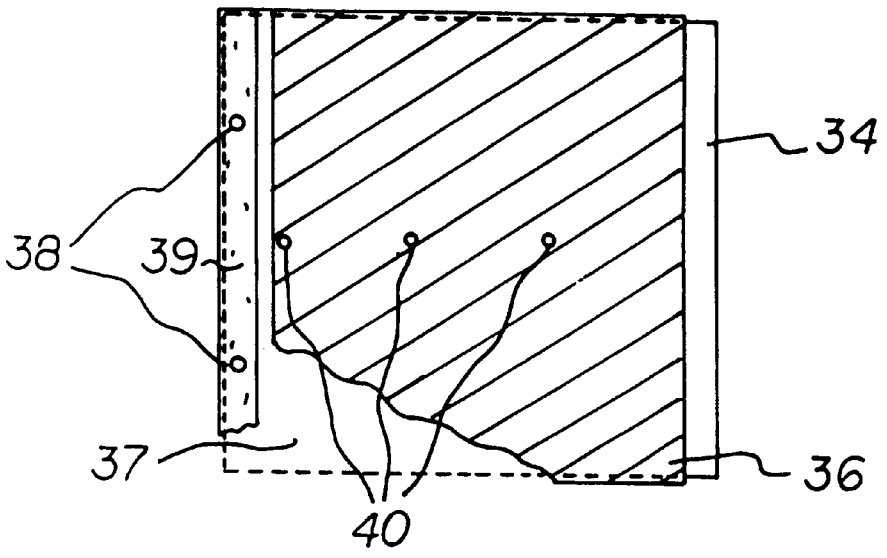
FIG. 6 is a detailed view of an album page made from a transparent plastic sleeve with heat seal spots to bind to the spine with a plate.

Referring now to the figures in general, FIG. 1 is the outlook of the assembled photo album. FIG. 2 shows a specially designed plastic holder, which will be described as the spine 1 throughout the following text. With the use of the spine 1, manufacturers are able to produce different structures of photo albums. Manufacturers can either produce photo albums with transparent plastic pockets filled with printed paper and hung onto posts and locked to the spine, or transparent plastic pockets filled with printed paper and locked to the spine 1 with the use of a specially designed plate 2.

According to FIG. 2, the spine 1 is a plastic injection molding in a rectangular shape. There are four panels of plastic paired up to make up two plastic walls 3,4 and 5,6 facing opposite each other pair. The main function of the plastic walls 3,4 and 5,6 is to hold the spine 1 together and to hold the other members of the photo album together. There are three types of holes or apertures, 11*a*, 11*b*, and 12, punched in the plastic walls 3,4 and 5,6. The holes or apertures 11*a*, 11*b* are for the posts 21*a* to lock the album pages from outside. The holes or apertures 12 are provided for the posts 21*b* to lock the album pages from the inside and will be penetrating the album pages as well so that the album pages are basically unmovable and stay within the spine 1 as shown in FIG. 3. If this is not accomplished, there is a possibility that the posts 22 will get curved or bent by the force created by flipping the album pages filled with photographs. The holes or apertures 11*a*, 11*b*, and 12 punched in the plastic walls 5,6 are penetrated completely. As for the holes or apertures 11*a*, 11*b*, 12 punched in the plastic wall 3,4, they penetrate the inner panel 3 completely, but only half of the outer panel 4. The major use of these holes or apertures 11*a*, 11*b*, and 12 is to allow the posts 21*a*, 21*b* as shown in FIG. 3 to lock the album pages 23 hanging onto the posts 22 to the spine 1. The post 21*b* inserting into the aperture 12 is only applicable to the album pages hanging onto the posts 22 and is not used for any other types of album pages bound to the spine 1 with at least two posts 21*a* vertically inserted. This type of album pages are first installed to a plate 2 with two tubes 41 standing in the front surface as shown in FIG. 7 then locked to the spine 1 by inserting the posts 21*a* into the hollow tubes 41 provided in the plastic plate 2.

On the two opposite ends of the spine 1, there are two pieces of curved plastic panel 7,8 serving to hold the plastic panel walls 3,4 and 5,6 together to form the spine 1. Another use of these two pieces of curved plastic panel 7,8 is to act as a stopper to retain the album pages within the spine 1 as shown in FIG. 8. There are two gaps or apertures 9, 10 created in between the two pairs of plastic walls 3,4 and 5,6. The main use of these two apertures 9, 10 is to allow the front cover hinge 19, the back cover hinge 20, and the spine cover sheet 16 to insert inside with the posts 21*a* going through the apertures in the hinges 19, 20 and spine cover sheet 16. The cover hinges 19, 20 and the spine cover sheet 16 are retained to the spine 1 by the posts 21*a*, since the apertures 11*a*, 11*b* in one of the plastic panel 4 is only penetrated halfway. The posts 21*a* can lock into the spine 1 firmer. The diameter of the posts 21*a*, 21*b* should be slightly less than the diameter of the holes 11*a*, 11*b*, 12 in the spine 1. The length of the posts 21*a*, 21*b* should be less than the width of the spine 1.

There are a plurality of indentations 13 in each end of the spine 1. The indentations 13 are for the use of placing the album pages 23 hanging onto the posts 22. The number of indentations 13 in the spine 1 will be determined by how many photographs the photo album will accommodate. There are some supporting bridges 14, 15 in the spine 1. The bridges 14, 15 are not connected as shown in the illustration because the album pages 23 hanging on posts 22 are to be placed to the indentations 13 from the front through the openings of the bridges 14, 15, as placing the album pages 23 from the back of the spine 1 is not possible. The main function of the connecting bridges 14, 15 is to give the spine cover sheet 16 support and help keep the proper shape.

It is important to mention that the drawings and the descriptions of the spine above merely serve as an example of the invention to the concept of using a spine as a new means of binding the member parts of a photo album together. Therefore, it is not limited to the material and shape mentioned above.

PHOTO ALBUM PAGES

There will be three types of album pages introduced. These three types of album pages are designed to accommodate to the spine 1. Basically two types of the album pages are hung onto the posts and one type of album page is inserted into a specially designed plastic plate 2 and locked to the spine 1 with at least two posts 21 that function like a ring binder.

1) TRANSFORMING A THREE-SIDED SEALED DUAL LAYER PLASTIC INTO TWO SHEETS OF ALBUM PAGE

FIG. 4A shows a single pocket slot-in photo album page. Two pieces of identical size printed paper 25 are inserted into a transparent plastic pocket 24. The length from top to bottom of the transparent plastic pocket 24 should be equal to the length of the printed paper 25 from top to bottom, the combined width measured left to right of the two printed paper 25 should be less than the width of the transparent plastic pocket 24 measured from left to right and as a result there will be a gap 26 created in between the two printed papers 25. The gap 26 has two main functions: one of the functions is acting as a divider when the transparent plastic pocket 24 is folded in half symmetrically creating two album pages 23; and the second function is to allow the album pages 23 to hang onto the post 22. There will be two holes 32 drilled in the center of the plastic pocket 24 opposite each other using the gap 26 as a divider which are used for the insertion of a post 22 to lock the album pages firmly to the spine 1. The holes 32 must be in accordance with the hole 12 in the spine 1. When the transparent plastic pocket filled with printed papers is folded symmetrically into two halves, two sheets of album pages or four pages of album pages 23 with four pockets are created. The photographs are inserted into the album pages 23 from the top. A plurality of album pages 23 may hang to one post 22 depending on how many photographs the photo album is designed to accommodate. The last step is to install the posts 22 with album pages 23 to the indentations 13 in the spine 1 and lock tight with at least two posts 21*a* in the outside and one post 21*b* in the inside as shown in FIG. 3.

2) HEAT-SEALING TRANSPARENT PLASTIC TO MAKE PHOTO ALBUM PAGES AS A MEANS OF STORAGE

Referring now to FIG. 8, one piece of printed paper 37 is inserted into a transparent plastic sleeve 36 with the left and right being open, the top and bottom sealed. The height of the printed paper 37 should be equal or less than the height of the transparent plastic sleeve 36 measuring from top to bottom. Two strips of thicker paper 34,39 are adhered in the two extreme left and right sides of the printed paper 37, the left will be the page hinge 39 and the right will be the memo writing strip 34. The combined width of the transparent plastic sleeve 36, the memo writing strip 34 and the page hinge 39 should be less than the width of the printed paper 37 measuring left to right. FIG. 8 is an example of a double pocket page, and therefore one row of at least two round holes 40 are drilled and acts as a boundary to divide the printed paper 37 into two equal halves. When the album page is designed to accommodate three photos, then there will be two rows of round holes to divide the album page into three equal parts. There will be two holes 38 punched in the page hinge 39, the holes 38 should be in accordance to the holes 11*a*, 11*b* in the spine 1 and the hollow tubes 41 in the plate 2 as shown in FIG. 7. When assembling the album pages to the spine 1, the album pages are inserted into the plastic plate 2 first as illustrated in FIG. 7, then the plastic plate 2 will lock to the spine 1 by inserting posts 21*a* through the hollow tubes 41.

Another function of the memo writing strip 34 is to act as a stopper that prevents the photographs from falling out since the photographs are inserted from the side farthest from the spine or in the side where the memo writing strip 34 is. The advantage of inserting from this side is making insertion of the photographs easy and smooth in comparison to the existing products on the market. In most of the photo albums on the market photos have to be inserted from the side nearest to the spine which is very difficult because the album pages near the spine will be bulging up and making the insertion difficult. The only way to make insertion easy from the side closest to the spine is to use a wider space which means more raw material and in turn higher material cost.

The major reason why this invention is using circular apertures instead of rectangular holes used in the market is because circular apertures could be drilled, which means a big pile of paper can be drilled at one time. As for the rectangular holes seen in the market, these would have to use a metal die to cut. Die-cutting will only die cut a few pages at one time which is a very expensive part of the production process.

One of the special features will be introduced at the back of the cover panels, either in the front panel or in the back cover panel, or even on both cover panels. A piece of printed paper 66 with specific contents will be adhered to the back of the cover panel as shown in FIG. 8. A plurality of photo covers will be supplied with each photo album. The contents such as the name of the owner, special occasions, address and so forth will be included. The photo covers are used to retain the owner's selected photograph. In one of the backs of the cover panel, a pouch for the storage of negatives will be provided. The first page of the photo album is a full color printing illustrating the effect of the photo album page when filled with photographs. This page is used as a decoration to the photo album and as a guideline as illustrated in FIG. 8.

COVER PANELS/FRONT COVER PANEL

Figure 9A:
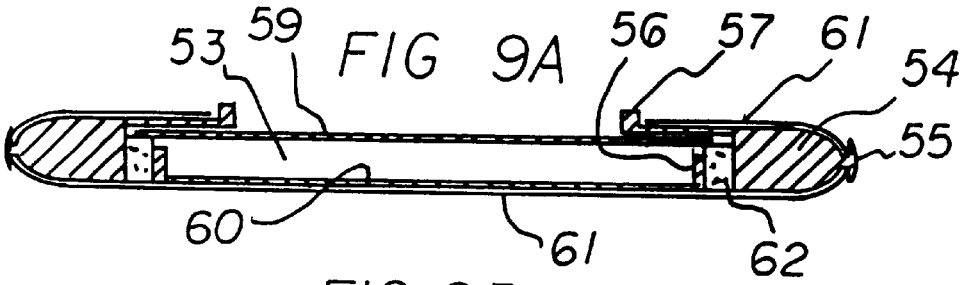
FIG. 9A is a cross-sectional view of the front cover from A to A of FIG. 9.
Figure 9B:
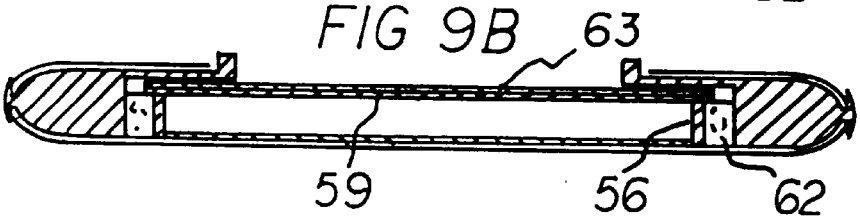
FIG. 9B is a cross-sectional view of the front cover demonstrating the option of placing a new design over the original design.
Figure 9C:
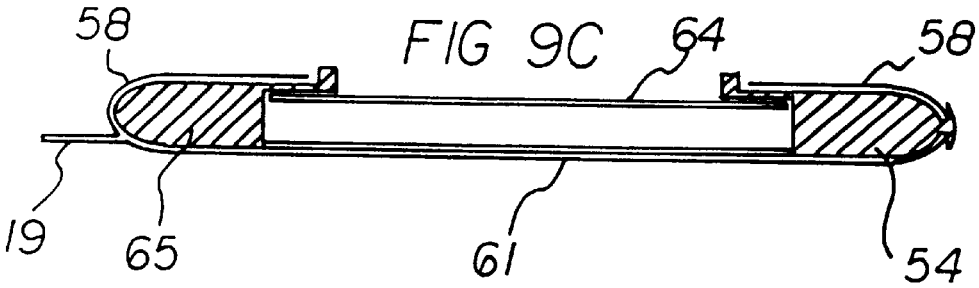
FIG. 9C is a cross-sectional view of the front cover from B to B of FIG. 9.

In this invention, there are two types of cover panels to be introduced. Both types can be used as the front cover panel and/or the back cover panel. FIG. 9 is an illustration of a plastic injection molding which is the skeleton of the front cover panel in this example. The skeleton is basically plastic molding and consists of two frames connected by a number of bridges 54 to give sufficient support for the two frames to hold to each other and to have enough support to be a cover panel. The front of the inner frame 57 should be slightly taller than the front of the outer frame 58 which gives the cover panel a sloping effect, but the back of both the inner frame 57 and the outer frame 58 is even or flat. When a backing paperboard or cardboard is adhered to the back of the plastic molding, some space in the form of a tray 53 is created as shown in FIG. 9 and FIG. 9A. In FIG. 9B and FIG. 9C the tray 53 is for the display of a selected design or a display of an actual ornamental object or some kind of three-dimensional design, which will be described in detail later.

Figure 10:
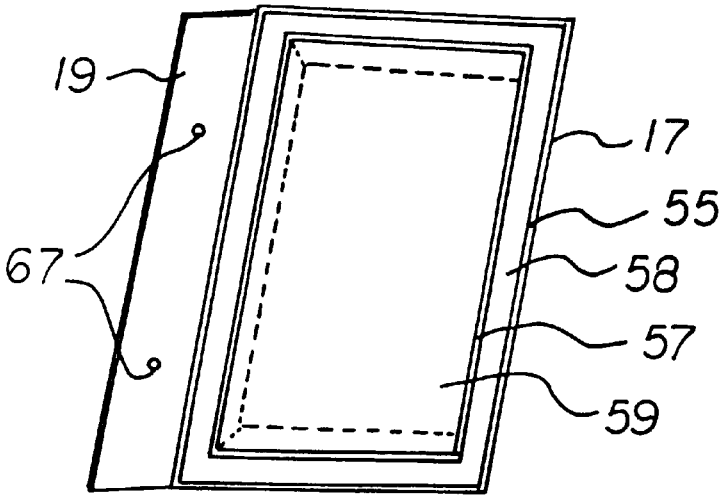
FIG. 10 is a detailed view of the front cover.

One of the very special features of the front cover panel is that as illustrated in FIG. 9A, FIG. 9B, and FIG. 9C, the three edges that are farthest from the spine 1 are made round and curving inward up and down which creates a groove 55. The purpose of designing such groove 55 in the front cover panel is to give the front cover panel a very unique look. As there will be designed or printed paperboards 61 adhering to the front of the front cover panel in order to complete the making of the front cover panel, the edges of the printed paperboards 61 will somehow fit into the groove 55 and give the cover panel a natural and smooth finishing look. There must be some kind of hinge that permits the spine 1 to connect the cover panel together. As shown in FIG. 9C and FIG. 10, the side closest to the spine 1 has no groove 55, and the printed paperboard 61 in this side is designed to be longer and will eventually meet up and seal together to become one piece that serves as a cover hinge 19 as outlined in FIG. 9C. At least two holes or apertures 67 are punched in the cover hinge as illustrated in FIG. 10. These apertures 67 must be in accordance with the holes 11*a*, 11*b* punched in the spine 1 so that the posts 21*a* will be able to retain the cover hinge 19 within the apertures 9,10 provided in the spine 1.

There are three different structures to the front cover, which will give the front cover three different appearances when completed. One of the structures is two pieces of well die-cut and designed paperboards cardboard adhered to both sides of the skeleton of the cover panel. In this case, the paperboards or cardboard will be covering the outer frame 58, inner frame 57, and the tray 53 as well. In this manner, the edges of the paperboards or cardboard 61 are hidden within the groove 55. As mentioned above, the side closest to the spine 1 has no groove 55 in which case the paperboards 61 are designed to be longer for the creation of the cover hinge 19. The front covers produced with this method will be similar to the front covers commonly found in the market except the groove 55, which is a special feature in this invention.

Producing a totally different structural look of the front cover with the same piece of plastic molding M is possible with the method describe below. As described above, the plastic molding M is basically formed by two frames 57,58 and connected by a number of supporting bridges 54, and the inner frame 57 is taller than the outer frame. Therefore, designers will make use of the height difference to place a piece of design in the tray space 53. In FIG. 9, there are two horizontal plastic bars 56 in the top and bottom of the plastic molding M. These two plastic horizontal bars play a very important role in this method of making the front cover. FIG. 9A is a cross-sectional view of the plastic molding M. As shown, the horizontal bars 56 are actually in a lower position than the inner frame 57, the supporting bridges 54 in the top and bottom are made differently than the other supporting bridges in the left and right side, a portion of the supporting bridges 54 are eliminated in the lower portion and create some empty space inbetween the inner frame and the supporting bridges 54 as illustrated in FIG. 9A. A similar length of sponge 62 is adhered along the horizontal bars 56, and the height of the sponge 62 is taller than the horizontal bars 56 as shown in FIG. 9A. A piece of cardboard 59 with designs will be slotted within the inner frame and supported by the sponge 62. In instances when consumers want to place their own favorite design all they need to do is just simply place their design on top of the original design and compress to allow the design to slot within the space between the inner frame 54 and the horizontal bars 56. In this manner, the design should be retained within the space between the inner frame 54 and the horizontal bars 56 by the natural elasticity of the sponge 62 and the inner frame 54 and the horizontal bars 56 acting as a stopper leaving no empty space for the design to move. This is best illustrated in FIG. 9B. Printed cardboard 61 will be adhered to the front and back of the plastic molding M as shown in FIG. 9B. As in the method described above, the hinge 19 will be made by the same way.

Designers are allowed to make the best use of the tray space 53 created by the height difference between the two frames 57,58. An actual ornamental object or three-dimensional design according to the size of the tray space 53 can be displayed within and protected by a piece of clear glass or a rigid clear plastic.

It is very necessary to point out why the invention for the cover panel uses two frames 54,55 with supporting bridges 54 connected together instead of using a complete piece of plastic panel. There are three major reasons. The first reason, of course, is because of the different changes that can be done with such plastic molding M. The second reason is to minimize the usage of raw material such as the amount of plastic to minimize cost. The third reason relates to the weight of the photo album which could be very heavy when filled with photographs. Therefore manufacturers should make use of any opportunity to produce a lighter photo album whenever possible by using less raw material or lighter raw material. FIG. 16 is the appearance of the front cover when completed.

PACKAGING & LABELING

Packaging is usually the final stage in production. There are many types of packaging for the photo album. One of the most expensive ways is by packing each photo album in a box thereby protecting each individual photo album from being scratched and damaged. In addition, all the advertisement and particulars are printed on the individual boxes creating one of the best packaging methods but also one of the most expensive. One of the most economical ways of packaging is by shrink wrapping. A piece of styrofoam will be placed inside the photo album for cushioning and protection, a piece of paper printed with all the particulars and advertisements will be placed together with the photo album and shrink wrapped together. A drawback to the shrink wrapping method is that it does not give the packaging an elegant look and sometime even makes the photo album less elegant. The reason is because there will be gaps uncovered along the three sides other than the side with a solid spine, and therefore when the photo album is being shrink wrapped with heat, the photo album may be damaged or become uneven.

Figure 11:
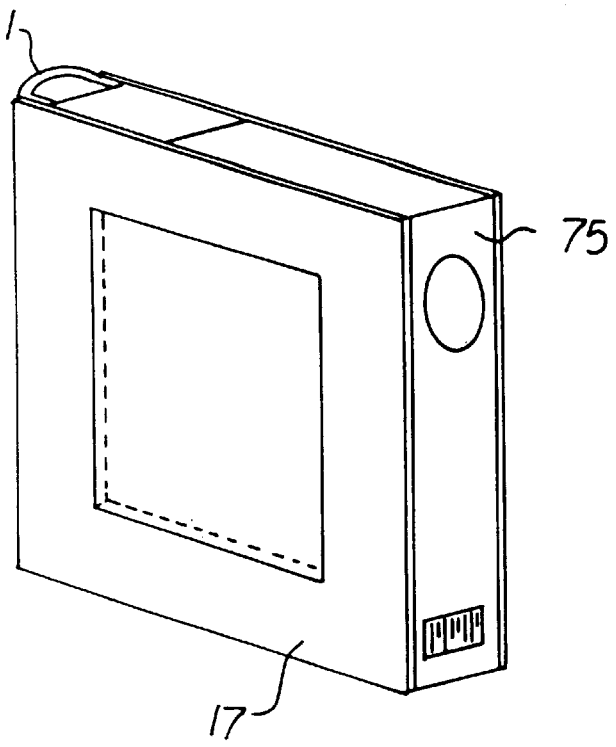
FIG. 11 is a detailed view of the packaging.
Figure 11A:
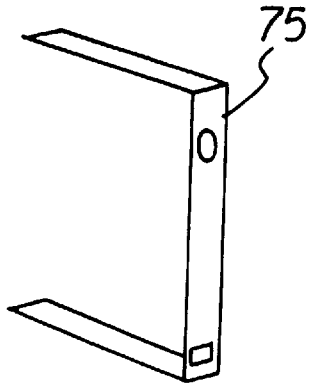

FIG. 11 illustrates the method of packaging in this invention. It will be more or less the combination of the two methods described above by taking the advantages of these two methods. A piece of corrugated cardboard 75 will be used here, all the advertisements will be directly printed on this corrugated cardboard 75 or adhered to a piece of printed paper adhered to the corrugated cardboard 75. This piece of corrugated cardboard 75 will be folded into three parts which will look very much like a U shape. As there are four sides to a photo album, one side with a spine and the other three sides empty or open without support, the U-shaped corrugated cardboard will be placed to cover these three sides and making every side of the photo album with a solid support. Then the whole piece will be shrink wrapped. The advantage of this method is that the photo album will be well protected and looks as elegant as packaging with an individual box, but the cost is very economical and without blocking the original designs in the cover of the photo album.

Figure 12:
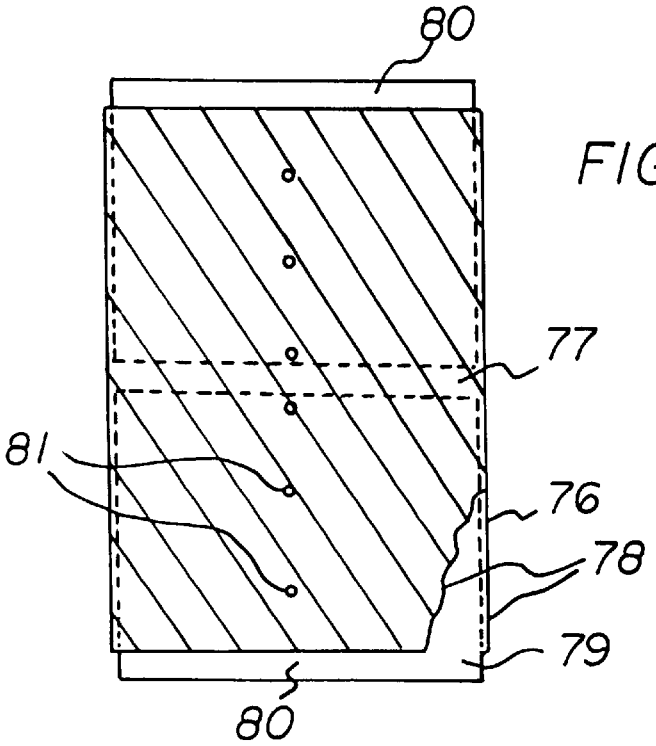
FIG. 12 is a detailed view of one sheet adapted to be folded in half at a center line over a post with circular apertures in the paper whereby the plastic may be heat sealed to form four pockets for the receipt of photographs and with memo paper extending exteriorly for writing memos.
Figure 13:
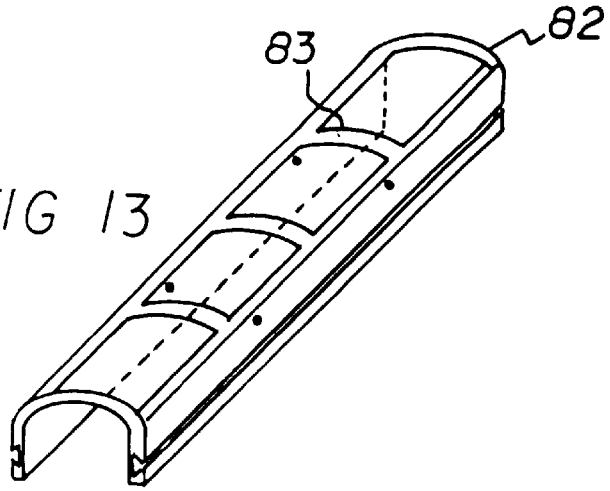
FIG. 13 is a modified spine constructed in accordance with an alternate embodiment of the invention with recesses for the front and back cover and arcuate sheet in lateral recesses and with arcuate fingers extending across the back for the receipt of the spine.
Figure 14:
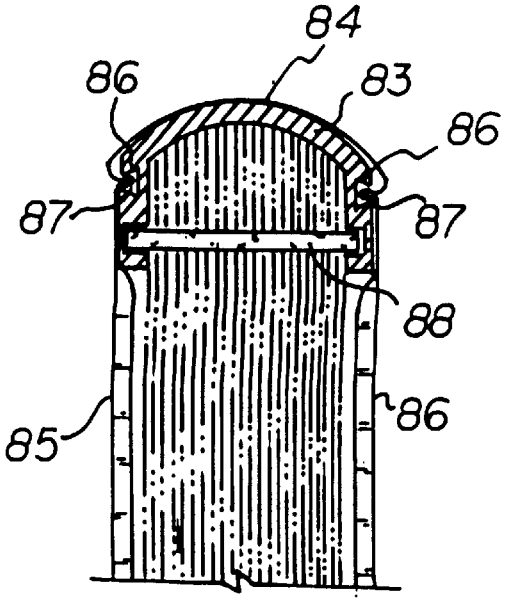
FIG. 14 is a cross-sectional view taken centrally through the spine of FIG. 13 and illustrating the front cover, the back cover, the spine and rods in the recesses.
Figure 15:
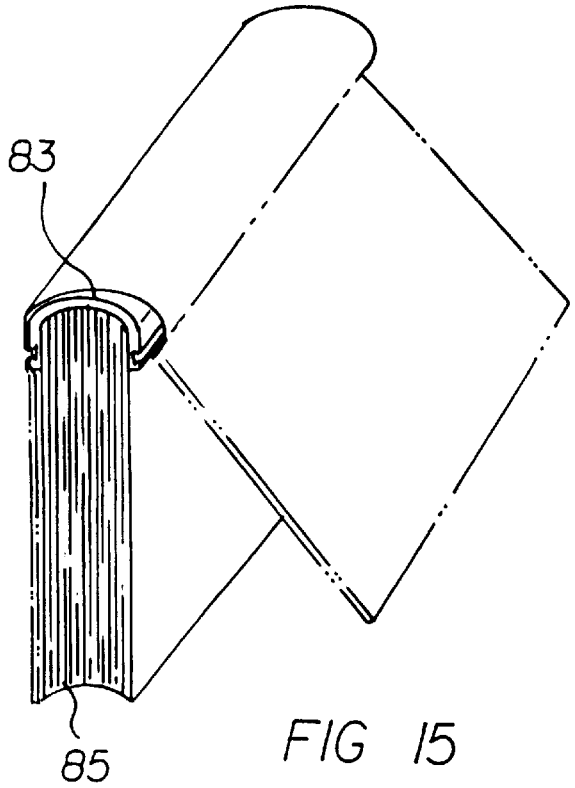
FIG. 15 is a perspective view of the book of FIGS. 13 and 14 immediately prior to completion.

FIG. 12 illustrates an alternate form of a page. The page 76 of FIG. 12 is adapted to be folded along a central fold line 77. It has transparent plastic sheets 78 top and bottom with an opaque paper 79 therein. The paper extends beyond the free edges of the transparent plastic to provide a region 80 on both sides for writing notations. In addition, circular holes 81 are formed in the paper whereby the plastic above and below may be heat sealed together to generate four pockets on each side of each sheet for a total of eight pockets.

FIGS. 13 through 16 are directed to embodiments employing an integrally formed spine 82. Such spine has integrally molded side walls similar to the separate side walls of the prior embodiments and with arcuate supports 83 bridging the opposed side walls. The arcuate supports provide greater support for the spine cover sheet 84. In such embodiment, the spine cover sheet 84 is preferably formed integrally with the front cover 85 and back cover 86. This allows the interior edges of the pages to form a convex cross section conforming to the curvature of the supports 83. As can be seen in FIGS. 15 through 19, this presents the appearance of an expensive bound book with a concave edge 85 formed by the exterior free edges of the pages.

In these embodiments, the recesses 86 in the side walls are formed on the lateral faces and take a dove-tail configuration. By constructing the spine cover and front and back covers integrally, a flexible linear extent thereof front and back may be positioned within the recesses with a supplemental cylindrical rod 87 positioned within the recess to hold the entire assembly together during operation and use. In such embodiment, the page pins 88 extending through apertures in the pages functions to hold the pages in their proper orientation. In these embodiments, it is preferred that the page pin extend through an aperture in one side wall of the spine into a cylindrical recess on the opposite side thereof.

Minor modifications of these embodiments can be seen in reference to FIGS. 16, 17, 18 and 193. In such embodiments, the front cover, back cover and back spine are shown to appear essentially integral in the embodiments of FIGS. 16 and 17. In the FIG. 18 embodiment, the top and bottom plates are formed integrally with the side walls whereas in FIG. 19, the top and bottom plates are eliminated to show the full extent of the top and bottom of the sheets.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent is as follows:

1. A book system with pages for the removable receipt of photographs and like image-bearing documents for maximized convenience and aesthetic appearance with minimized cost comprising, in combination:

a spine including four walls, an interior front wall and an exterior front wall and an interior rear wall and an exterior rear wall, all of the walls being planar in essentially parallel relationship with each other and with the interior and exterior front walls being closely spaced and with the interior and exterior rear walls being closely spaced and with an enlarged opening therebetween for the receipt of pages, the spine also including two panels, a top panel and a bottom panel, the top panel and bottom panel being in parallel relationship with each other and coupled at the top of the walls and at the bottom of the walls for the receipt of pages therebetween, the four walls and two panels being in a rectilinear configuration with an open planar face from which pages may extend and a closed arcuate face opposite therefrom, the arcuate face including three sets of curved fingers on each interior wall to define a curvature opposite from the open planar face, the interior faces of the panels being formed with a rectilinear section with indentations opening toward the arcuate face for the receipt of ends of posts therewithin and with the walls being formed with circular inboard apertures and outboard apertures for the receipt of inboard spine pins and at least one outboard spine pin therethrough;

a plurality of cylindrical posts having opposite ends adapted to be received in the indentations of the rectilinear sections for the receipt of pages therearound;

a pair of inboard spine pins passing through the side walls to retain the posts in position within the recesses;

at least one outboard spine pin passing through the side walls and through apertures in the pages;

a plurality of pages of an extended length with a central fold line adapted to be positioned over the posts and to extend outwardly in a direction away from the arcuate face, the pages having apertures for the receipt of the outboard spine pins;

a front cover and a back cover, the front and back covers each in a generally rectangular configuration with an inner edge adapted to be received between an interior wall and an exterior wall at the open face; and a flexible sheet in a semi-cylindrical configuration having free parallel edges positioned between the interior and exterior walls at the closed face and overlying the curved fingers.

2. A book comprising:

a spine formed of a plurality of walls including a front wall and a rear wall, each with an axial recess therewithin, the spine also having a plurality of panels including a top panel and a bottom panel with the top panel and bottom panel being in parallel relationship with each other adjacent to the top of the walls and adjacent to the bottom of the walls, the walls and panels being in a rectilinear configuration with an open planar face from which pages may extend and a closed face opposite therefrom, and with the walls being formed with circular apertures for the receipt of pins therethrough;

a plurality of pins passing through at least some of the side walls to retain the pages in position; and a plurality of pages positioned within the spine and extending outwardly in a direction away from the closed face.

3. The book as set forth in claim 2 and further including a front cover and a back cover, the front and back covers each in a generally rectangular configuration with an inner edge adapted to be received within the recesses.

4. The book as set forth in claim 2 wherein the walls include an interior front wall and an exterior front wall and an interior rear wall and an exterior rear wall, with the interior and exterior front walls being closely spaced and with the interior and exterior rear walls being closely spaced and with an enlarged opening therebetween with the recesses being the spaces between the interior and exterior walls.

5. The book as set forth in claim 2 wherein the recesses are in a dove-tail configuration on the exterior faces of the walls with cylindrical rods positionable therewithin.

6. The book as set forth in claim 2 and further including a flexible sheet having free parallel edges positioned between the interior and exterior walls overlying the closed face.

7. The book as set forth in claim 2 wherein the interior faces of the panels are formed having a rectilinear section with indentations opening toward the closed face for the receipt of ends of the posts therewithin; and a plurality of pins passing through at least some of the side walls to retain the pages in position.

8. The book as set forth in claim 2 and further including a plurality of apertures extending through the pages adjacent to the edge received by the spine with the pins extending therethrough.

9. The book as set forth in claim 2 wherein the front cover sheet includes a cardboard backing internally and an injection molded frame internally with a central rectangular receiving area in the center and outwardly extending ribs terminating at free ends adjacent to the periphery of the cardboard with curved tips thereat and with a paper covering thereover.

10. The book as set forth in claim 2 wherein the pages are fabricated of a central paper and a transparent plastic covering with slits in the covering for the introduction of and removal of photographs and like indicia-bearing sheets.

11. The book as set forth in claim 2 wherein the sheets include circular apertures through the paper for heat sealing the plastic above and below to create separate pockets for discrete photographs and like image-bearing objects.

12. The book as set forth in claim 2 and further including paper over the plastic at the external end thereof for the printing of indicia thereon by a user.

13. The book as set forth in claim 2 wherein the pages have their interior edges, adjacent to the spine, forming a convex cross section with their exterior edges, remote from the spine, forming a concave cross section.

14. The book as set forth in claim 2 and further including an integrally formed front cover and back cover and spine.

15. The book as set forth in claim 2 and further including for use in a scrapbook, a page for removably receiving photographs and the like comprising a sheet of opaque material with plastic transparent sheets above and below, the opaque material having circular apertures in a linear array with the plastic being heat sealed through the apertures to form a plurality of pockets between the opaque material and transparent sheets and with a linear opening between the transparent sheets and opaque material adjacent the remote edges of the opaque material and plastic sheets for introducing and removing photographs and the like to and from the pockets.

* * * * *